United States Patent [19]

Imagawa

[11] 3,977,688

[45] Aug. 31, 1976

[54] STRUCTURE FOR CONNECTING A SKI BINDING CLAMP TO A SKI

[75] Inventor: Katsuhiko Imagawa, Hamakita, Japan

[73] Assignee: Nippon Gakki Seizo Kabushiki Kaisha, Tokyo, Japan

[22] Filed: Apr. 2, 1975

[21] Appl. No.: 564,627

Related U.S. Application Data

[62] Division of Ser. No. 421.929, Dec. 5, 1073, abandoned.

[30] Foreign Application Priority Data

| | | |
|---|---|---|
| Dec. 30, 1972 | Japan | 48-1767 |
| Jan. 31, 1973 | Japan | 48-12592 |
| Feb. 9, 1973 | Japan | 48-15718 |
| Feb. 15, 1973 | Japan | 48-18678 |
| Apr. 10, 1973 | Japan | 48-39997 |

[52] U.S. Cl. ..... 280/633; 280/607

[51] Int. Cl.[2] ..... A63C 9/00

[58] Field of Search ..... 280/11.35 H, 11.35 T, 280/11.35 D, 11.35 A, 11.35 E, 11.35 C, 11.35 B, 11.35 R, 11.3

[56] References Cited

UNITED STATES PATENTS

| | | | |
|---|---|---|---|
| 3,216,737 | 11/1965 | Iverson et al. | 280/11.35 K |
| 3,219,359 | 11/1965 | Schneider | 280/11.35 R |

FOREIGN PATENTS OR APPLICATIONS

| | | | |
|---|---|---|---|
| 1,077,640 | 5/1954 | France | 280/11.35 K |
| 577,025 | 5/1933 | Germany | 280/11.35 C |
| 469,492 | 4/1969 | Switzerland | 280/11.35 T |
| 268,189 | 8/1950 | Switzerland | 280/11.35 K |

*Primary Examiner*—M. H. Wood, Jr.
*Assistant Examiner*—Milton L. Smith
*Attorney, Agent, or Firm*—Wenderoth, Lind & Ponack

[57] ABSTRACT

A structure for connecting a ski binding clamp to a ski, wherein one or more engagement members secured to the bottom part of a ski binding clamp are inserted into holding cavities of a corresponding number in a bracket secured to the top surface of a ski, after which the ski binding clamp is caused to move within the same horizontal plane as that of the ski, thus engaging the engagement members attached underneath thereof with engaging means provided in the bracket.

10 Claims, 13 Drawing Figures

STRUCTURE FOR CONNECTING A SKI BINDING CLAMP TO A SKI

This is a divisional application of application Ser. No. 421,929, filed Dec. 5, 1973 and now abandoned.

This invention relates to an improvement in ski-bindings, and, more particularly, it is concerned with an improved structure for tight engagement of the binding clamp for ski boots in which the binding clamp is made more freely and readily attachable to or detachable from the ski, depending on necessity, even by ordinary skiers.

As is well known, a ski consists of a ski and ski-binding clamps which are mounted on the top surface of the ski at a position close to the center part thereof and which tightly clamp ski boots onto the ski (the clamp may be released by a safety device in an emergency). The ski binding clamp is usually divided into two portions a "toe piece" and "heel piece", which are adjustably fitted by means of conventional threaded screw bolts onto the center part of the ski, depending on the size and shape of ski boots of every skier.

Recently, synthetic material such as foamed plastics, etc. have been developed as the material for the ski, particularly as a core material, in place of the heretofore known ply-wood, and integrally molded ski of such synthetic resin material have been widely adopted. Since the synthetic resin ski can be readily manufactured, it is suited for industrialized mass-production, and, moreover, it is capable of imparting sufficient flexibility to the ski thus manufactured; hence, it has the advantage of increasing ski performance. On the other hand, however, this foamed synthetic resin, when used as the core material for the ski, is inferior in its engaging force to the conventional ply-wood board, and when the ski-binding is fitted onto the plastic ski by means of the conventional threaded screw bolts, sufficient strength for fitting cannot be obtained. In order, therefore, to increase this fitting strength in the plastic ski, attempts have been made to reinforce the plastic ski by embedding or implanting into the ski a seating for the ski binding made of wood or hard synthetic resin of sufficient thickness to enable the engagement bolts to be tightly screwed thereinto.

In other aspects, the fitting of the ski-binding onto the ski in the conventional manner requires retail shops to fit the ski binding clamps onto the ski at a position most appropriate to each and every customer, the fitting work requiring high skill and technique as well as considerable time and trouble. This constitutes a big burden on the part of the retailers.

Further, once the ski-binding is fixedly mounted on the ski with threaded screw bolts, it is difficult to be removed from the ski by the ordinary skier, and because the ski-binding is positioned nearly at the center part of the ski, it encroaches upon the nape of a skier who carries the ski on his (or her) shoulder. The consequence is that carrying skis on the shoulder becomes difficult and troublesome.

In order to solve these various problems on the part of the manufacturers, dealers, and users, the present invention proposes to abolish use of the conventional threaded screw bolts for fastening the ski-binding to the ski, so that the advantages of the synthetic resin ski in its manufacture and use may be fully enjoyed. In this newly proposed connecting structure, no particular skill or technique is required to attach the ski to or detach the ski from the ski-binding, and the work can be done simply and very quickly.

It is therefore an object of the present invention to provide an improved ski-binding of a type which requires no threaded screw bolt for fixedly mounting the same onto the ski.

It is another object of the present invention to provide an improved structure for mounting the ski-binding onto the ski, wherein an engagement part of a particular shape which projects downwardly from the bottom surface of the base plate of the ski-binding is simply slide-fitted into a holding bracket secured to the top surface of the ski, and is caused to engage with engaging means provided in this bracket.

The foregoing objects and detailed construction of the present invention will become more apparent from the following description when read in conjunction with the accompanying drawing.

Figure 1:
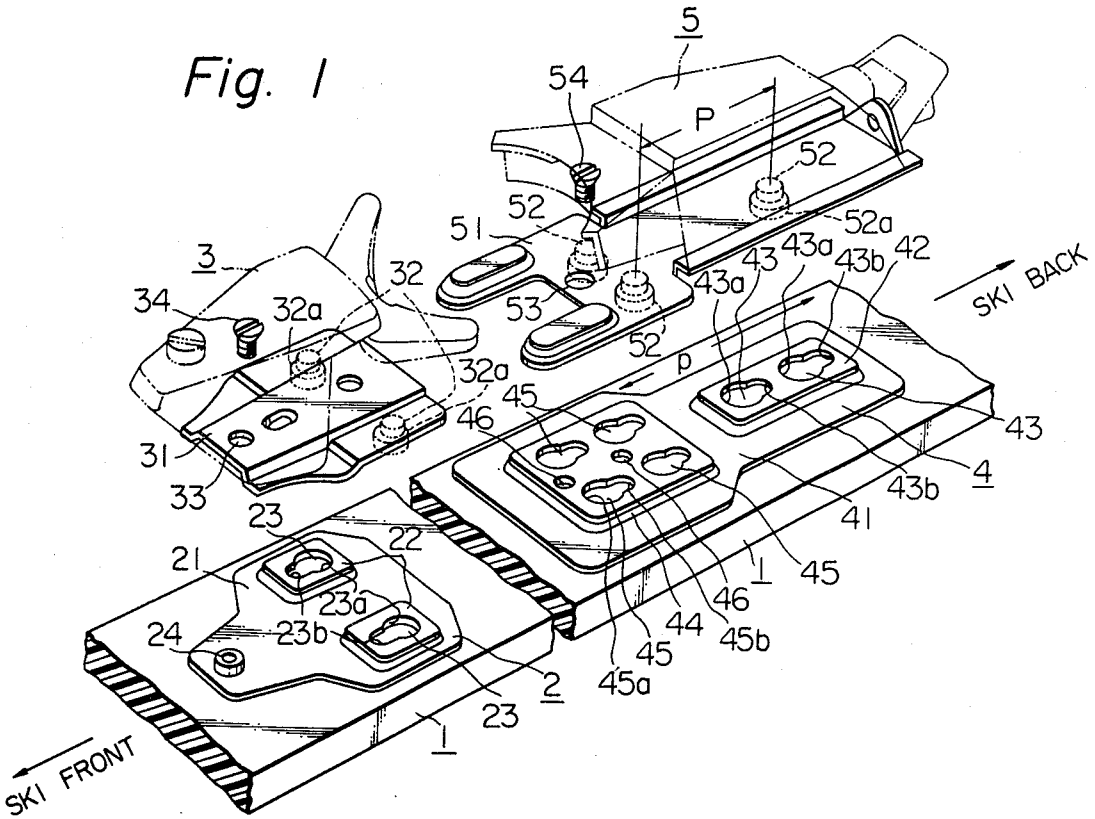
FIG. 1 is a perspective view showing the main parts of an embodiment according to the present invention.

Referring to FIG. 1 which shows one embodiment of the present invention, there are fixed nearly at the center part of a ski 1 a toe piece bracket 2 and a heel piece bracket 4 at a predetermined interval in conformity to a size of ski boots.

These brackets are of such structure that the portion thereof, on which the base plate 31, 51 of each piece is mounted, is raised upward, and a plurality of fitting holes 23, 43 are perforated in this raised portion 22, 42, and, at one end of the low level portion 21, 41 of the bracket, there is provided an inserting hole for a stopper screw 24, 46.

Each of the fitting holes 23, 43 is so formed that it comprises a hole 23*a*, 43*a* of a large diameter, through which the engagement part of the base plate of the ski binding clamp is inserted into a space defined by the raised portion of the bracket, and another hole 23*b*, 43*b* of a smaller diameter than the first-mentioned large diameter hole, with which the engagement part thus inserted is engaged at its bottom surface. Both holes are arranged contiguously in the longitudinal direction of the ski with one portion of each of them being overlapped at one position.

The smaller diameter hole, as viewed from the front edge of the ski, is disposed in the forward direction of the ski, i.e., before the large hole, in the case of the toe piece bracket, and it is positioned to the backward direction of the ski, i.e., after the large diameter hole in the case of the heel piece.

For the heel piece bracket 5, as shown in FIG. 1, there are formed two sets of the fitting holes 45, 43 in both forward and backward directions so that the fitting position of the heel piece may be changed for the interval provided in these forward and backward directions. As is clear from the drawing, the engaging shafts 52 for the heel clamp piece are provided on the bottom surface of the base plate 51, two in front and one in back. A triangle drawn by connecting the center axis of each engaging shaft 52 is in a relationship of congruence with each of two triangles which can be drawn by connecting the center of each engaging hole 45*a*, 43*a* formed in the bracket 4. In other words, the distance P between the engaging shafts in the front and back is equal to the distance *p* between the receiving hole 45*a* and 43*a*. Hence, it is possible to shift the heel clamp piece 5 for the pitch provided between the engaging holes 45 and 43.

A threaded hole 53 for a screw bolt perforated on the base plate 51 and another threaded hole 46 provided on the raised portion 44 of the bracket 4 at a position corresponding to the hole 53 are provided to maintain the fitted position of the heel clamp piece on the ski 1 through the bracket 4.

On the other hand, each of the engaging shafts 32, 52 projecting downwardly from the bottom surface of the base plate 31, 51 of the toe and heel pieces 3, 5 is formed in such a manner that its tip end forms a flanged portion 32*a*, 52*a* of a larger outer diameter than that of the shafts 32, 52, which is able to pass through the large diameter hole 23*a*, 43*a* of the above-mentioned fitting hole 23, 43, and its shaft portion 32, 52 is of a size for fitting within the small diameter hole 23*b*, 43*b* of the fitting hole. The length of the shaft portion 32, 52 is slightly longer than the wall thickness of the raised portion 23, 42, 44 of each of the brackets 2, 4, and the thickness of the flanged portions 32*a*, 52*a* is slightly thinner than the height of the space defined by the raised portion 22, 42, 44.

While no detail of fixing the stem of the engaging shaft 32, 52 is shown in the drawing, it is secured to the bottom surface of the base plate 31, 51 of the toe and heel clamp pieces by forming a countersink in the base plate, into which the stem of the engaging shaft 32, 52 of small diameter is inserted and caulked. It is, of course, possible for the stem of the engaging shaft to be welded to the bottom surface of the base plate so as to be an integral part of the clamp piece.

In the example shown in FIG. 1, the toe piece bracket and the heel piece bracket are separately fitted on the ski. However, both brackets 2, 4 may be formed in a single piece when the fitting position of the ski binding clamp is predetermined.

Since these toe piece and heel piece brackets are made of various materials of high rigidity such as, for example, aluminum, stainless steel, iron, and FRP (Fiber Reinforced Plastics), if they are directly fitted onto the top surface of the ski 1, they can hardly follow flexible bending of the ski per se. The result is that the flexibility characteristics of the ski become unfavorably sacrificed. Also, when a bracket of high rigidity is embedded into the ski, the embedded bracket inevitably interrupts the single, continuous body of the longitudinally extending ski, resulting in a considerable decrease in the ski's resiliency.

Figure 2:
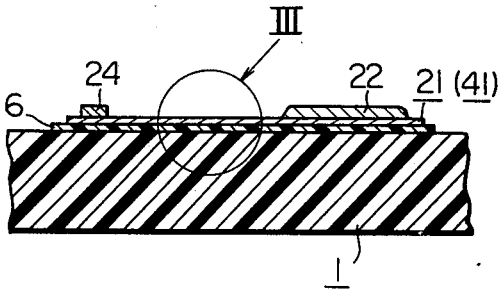
FIG. 2 is a longitudinal cross-section showing a manner, in which the holding bracket is fixed on the top surface of the ski.
Figure 3:
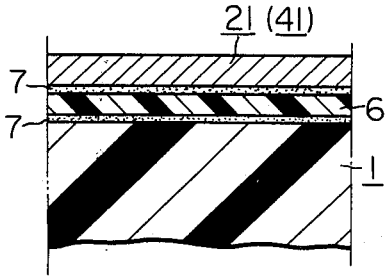
FIG. 3 is an enlarged longitudinal cross-section of the portion encircled in FIG. 2 above.

In order, therefore, to avoid such unfavorable phenomena, the present invention contemplates to first adhere an elastic board or spacer 6 onto the top surface of the ski by means of adhesive 7 to which the aforementioned brackets are fixed by means of the adhesive, as shown in FIGS. 2 and 3.

For the adhesive 7, those adhesives having sufficient flexibility such as epeoxy or rubber type adhesives are used.

For the elastic board or spacer 6, a rubber sheet of a thickness of 1 mm or less such as, for example, natural rubber, ABS, SBR, neoprene, urethane rubber, and so forth is used.

If the bracket 2, 4 is directly fitted onto the resilient, flexible ski 1, and if, for example, the ski receives a bending moment from its top or bottom surface, both the ski and the bracket will be deformed with the same radius of curvature. However, as the bracket possesses a particularly higher rigidity than the ski, the former is not deformed as much as the latter, with the consequence that there occurs a peeling phenomenon between the bracket and the ski due to difference in degree of deformation, or difference in the amount of strain imparted to each of them.

According to the present invention, however, by interposing the elastic board 6 between the ski and the bracket, the differentiated strains on both of them can be absorbed and offset by this elastic board 6. In other words, this interposed elastic board maintains the flexibility of the ski 1 without being hindered by the rigid bracket.

While, in the foregoing explanation, this elastic board has been considered an individual interposed part of the ski in view of the nature of the material constituting the same, it may, on the other hand, be taken in a broad sense as an intermediate layer of the ski, if it is considered an integral member constituting the ski.

Figure 6:
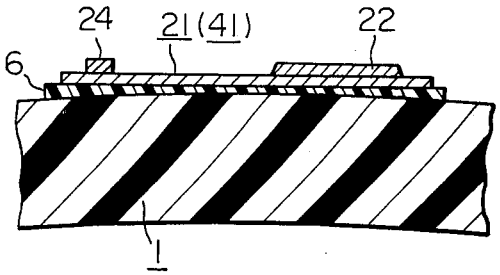
FIG. 6 is a longitudinal cross-section showing a state of the ski and the bracket being subjected to an external bending force.

With such an idea in mind, the presence of this elastic board 6 as the intermediate layer of the ski definitely serves to absorb the bending moment imparted to the ski as shown in FIG. 6, so that the bracket is not directly affected by the bending of the ski and can even be properly adapted to the mildly curved surface of the ski.

In the following, explanations will be made as to the practical mounting of the ski binding clamp onto the ski by means of the fitting structure according to the present invention.

First of all, brackets for both toe and heel pieces 2, 4 are fixed securely onto the top surface of the ski 1 by adhesive or are screwed at respective positions for fitting these clamp pieces. Next, the flanged portion 32*a*, 52*a* of the engaging shaft 32, 52 projected downwardly from the bottom surface of the base member 31,

51 of the binding clamps is inserted into the large diameter holes 23*a*, 43*a*, 45*a* of the fitting holes 23, 43, 45 formed in the top surface of the raised portion 22, 42, 44 of the bracket 2, 4, after which the engaging shaft is slid toward the narrower or smaller diameter holes 23*b*, 43*b*, 45*b* contiguous to the large diameter holes so that the flanged portions 23*a*, 52*a* may be tightly engaged with the small diameter holes at the bottom or inner surfaces thereof, and the engaging shaft 32, 52 of the engaging part settles in the small diameter holes 23*b*, 43*b*, 45*b* without slipping upward therefrom. Subsequently, by fastening together the base member 31, 51 of the binding clamp and the bracket 2, 4 with threaded screw bolt 34, 54 through the inserting hole 33, 53, both are fixed at their predetermined positions.

These fitting bolts 34, 54 are only to set the mounted positions of the binding clamps and do not fix them to the ski as is the case with the conventional fixing bolts; the purpose of their use is quite different.

In other words, according to the present invention, the binding clamp per se is fitted to the bracket by means of the engaging shafts which are engaged with the fitting holes of the bracket, and the stopper screw bolt is used only to set the position of the ski binding clamp against its movement back and forth, so that the binding clamp can be tightly fitted on a ski made of even a synthetic resin material of low mechanical strength. Moreover, the fitting can be done quickly and very easily without any special techniques or skills. The removal of the binding clamp from the ski can also be done easily by merely removing the stopper screw and sliding the engaging shaft out of the engaging hole of the bracket.

Figure 4:
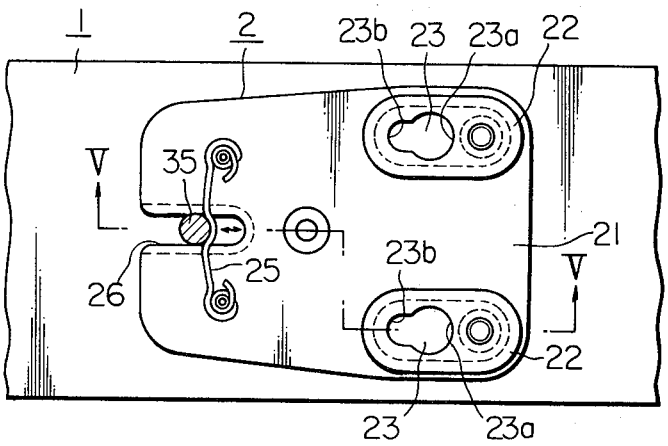
FIG. 4 is a top plan view showing a main part of another embodiment of the base plate structure according to the present invention.
Figure 5:
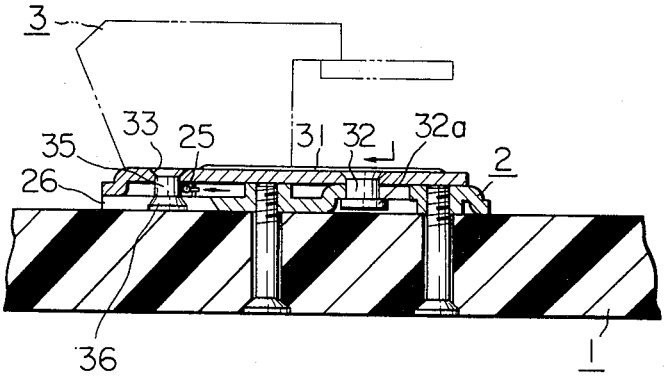
FIG. 5 is a longitudinal cross-section of the structure shown in FIG. 5 taken along the line V—V.

In place of the stopper screw as mentioned above, there is provided at the end of the bracket 2 a slot 26 in the longitudinal direction of the ski, and on the way of this slot, there is provided a spring 25 in the direction transverse to this slot, as shown in FIGS. 4 and 5. The spring 25 is fixed at both ends to the bracket 2, so that it can exert a biassing force toward the ski front. On the other hand, at the bottom of the base member 31 of the binding clamp 3, there is embedded a stopper pin 35 at a position corresponding to the bolt hole 24 of the bracket 2, both end parts of which possess a head portion 33, 36 having an increased diameter. This head portion fits in the abovementioned slot 26 of the bracket 2, contacts the transversely extended spring 25, and maintains the fixed positional relationship in the direction vertical to the ski.

Figure 7:
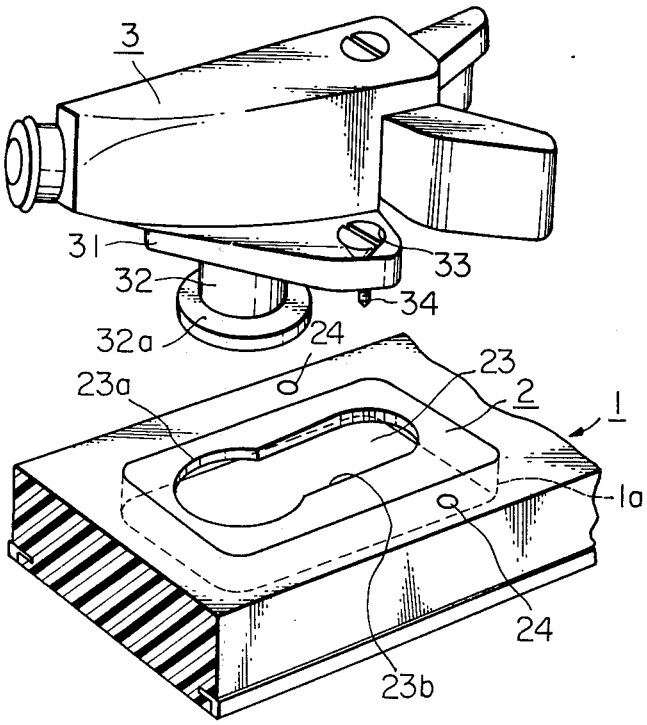
FIG. 7 is a perspective view showing another embodiment of the connecting structure for the ski-binding clamp and ski according to the present invention.

In another embodiment of the present invention as shown in FIG. 7, the ski 1 is provided with a cavity 1a for accommodating a bracket 2 at a position corresponding to a fitting position of the binding clamp (toe and heel pieces).

The bracket 2 is in the shape of a container having a hollow cavity therewithin with its top being open 23, and the top open end is covered with a top cover plate. The opening 23 in this top cover plate consists of an opening 23*a* in an appropriate shape such as a circle of a sufficiently large diameter to permit insertion therethrough of a flanged portion 32*a* of an engaging shaft 32 of a binding clamp 3, in continuation to which there is further provided an engaging slot 23*b* of a narrower width than the opening 23*a*. Accordingly, the hollow cavity within this bracket 2 is open in its top surface with the above-mentioned inserting hole 23*a* and the engaging hole 23*b*. The top surface of this bracket 2 is flush with the top surface of the ski 1 and does not protrude thereabove.

At positions in the ski 1 adjacent to both sides of the engaging hole 23, there are provided a set of bolt holes 24 to permit stopper screw bolts to be screwed therethrough to maintain the binding clamp in its mounted position on the ski.

The binding clamp 3 possesses a base plate 31 at its bottom surface from which an engaging shaft 32 for fitting the ski binding clamp to the bracket 2 extends downwardly. At the bottom end of this engaging shaft there is provided an engaging piece or flange 32*a* of a larger diameter than the shaft 32, the size of the flange being such that it may pass through the inserting hole 32*a* of the bracket 2, but may not escape from or get out of the engaging hole 23*b* of a smaller diameter.

At both brims of the base plate 31 of the binding clamp 3 there are provided bolt holes 33 in correspondence to the bolt holes 24 formed in the ski 1 through which a bolt 34 may be screwed.

In mounting the binding clamp onto the ski by way of the bracket 2, the engaging flange 32*a* of the engaging shaft 32 attached to the binding clamp 3 is inserted into the internal space or hollow cavity of the bracket 2 through the inserting hole 23*a*, followed by sliding of the binding clamp along the engaging hole 23*b* so as to cause the engaging shaft 32 to be positioned at the side opposite the inserting hole 23*a*, i.e., to the side of the engaging hole 23*b*. In consequence of this movement, the engaging flange 32*a* of the engaging shaft 32 is seated in the internal space of the bracket 2 and thereby engaged with the engaging hole 23*b*, i.e., the top covering, in a manner so as not to move in the direction perpendicular to the horizontal plane of the ski.

Further, in order to maintain this fixedly mounted state of the binding clamp 3, the binding clamp 3 and the ski 1 are fastened together threading the screw bolts 34 through the screwing hole 33 in the base plate 31 and the hole 24 in the ski. The screw bolts 34 can be easily screwed in and out by a coin.

Figure 8:
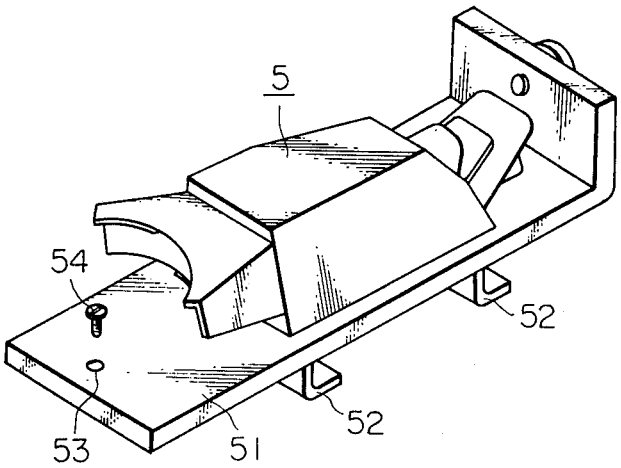
FIG. 8 is a perspective view showing a heel clamp piece and a construction of another embodiment of the engagement part at the bottom of the base plate.
Figure 9:
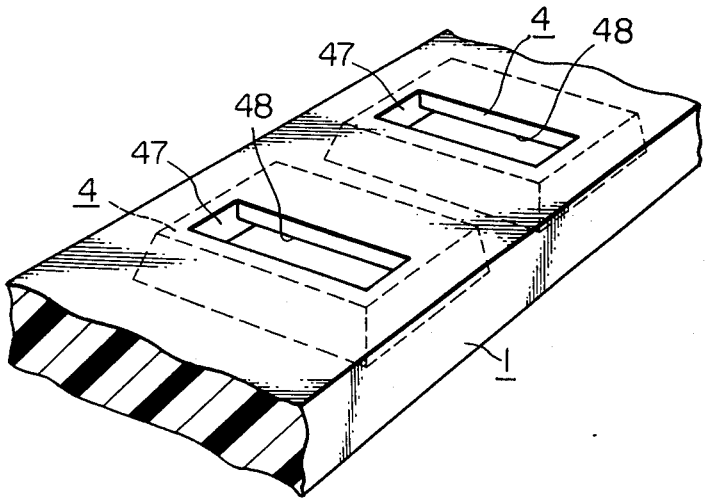
FIG. 9 is a perspective view showing still another embodiment of the bracket structure corresponding to the engagement part as shown in FIG. 8 above.
Figure 10:
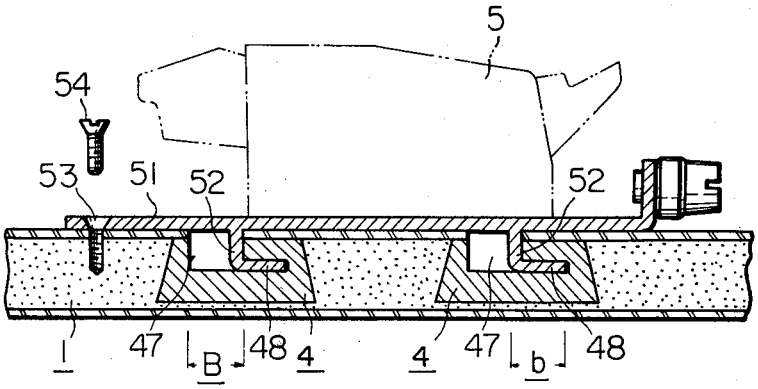
FIG. 10 is a longitudinal cross-section showing a main part of the assembly of the binding clamp and the ski using the structure shown in FIGS. 8 and 9.

In still another embodiment of the present invention as shown in FIGS. 8, 9, and 10, the structure for mounting and dismounting the heel piece of the ski binding is such that a plurality of brackets 4 made of light alloy such as aluminum is embedded in the top surface part of the ski 1 at a position where the heel piece is to be mounted.

Each bracket 4 is of a hollow container type having a transverse rectangular opening 47 on its top surface to permit insertion of an engaging hook projecting from the base plate of the heel clamp piece and an engaging groove 48 formed adjacent to the opening 47 along the bottom surface thereof in the transverse direction of the ski 1.

In this embodiment, two brackets 4 are provided in the ski in series in the longitudinal direction thereof at a predetermined interval. The top surfaces of the embedded brackets are flush with the top surfaces of the ski.

On the other hand, the binding clamp 5 is provided at the bottom part thereof with a base plate 51 which is flat and possesses a bolt hole 53 at one end. From the bottom surface thereof which faces the top surface of the ski, there extends a plurality of engaging hooks 52 corresponding in number to the number of brackets embedded in the ski 1. Each engaging hook 52 is shaped such that its stem extends vertically and downwardly from the bottom surface of the base plate with respect to the horizontal plane of the ski, and its tip end part is bent at the right angle so as to be parallel with the horizontal plane of the ski 1. In the embodiment shown in FIGS. 8 to 10, two such engaging hooks 52 are disposed in the longitudinal direction of the ski at an interval corresponding to that of the brackets embedded in the ski 1.

The width B of the space 47 in the bracket 4 is slightly wider than the length of the bent portion *b* of the engaging hook 52 of the base plate 51, thereby allowing the engaging hook to be inserted into the internal space 47 and enabling the bent portion *b* thereof to be intromitted into the engaging groove or inserting slot 48 upon sliding of the heel piece.

In assembling the heel clamp piece 5 to the ski 1 by way of the bracket embedded therein, the base plate 51 of the binding clamp 5 is positioned at the bracket 4 followed by insertion of the engaging hook 52 into the internal space 47 of the bracket 4 and the subsequent sliding of the engaging piece in the longitudinal direction of the ski 1 along the engaging groove 48 in the bracket 4 until it tightly engages the engaging groove 48. Then, the binding clamp thus settled in the bracket is maintained at its set position by a screw bolt 54 through the bolt hole 53 of the base plate 51 so that the binding clamp may not move in the longitudinal direction of the ski and slip out of the bracket or disengage therefrom.

When the binding clamp 5 is to be removed from the ski 1, exactly the reverse operations to the aforedescribed procedure are performed. That is, the screw bolt 54 is first removed from the ski, and then the base plate 51 of the binding clamp is caused to slide in the direction opposite to that at the time of mounting the same to disengage the engaging piece 52 from the engaging groove 48, whereby the binding clamp is readily separated from the ski 1.

Figure 11:
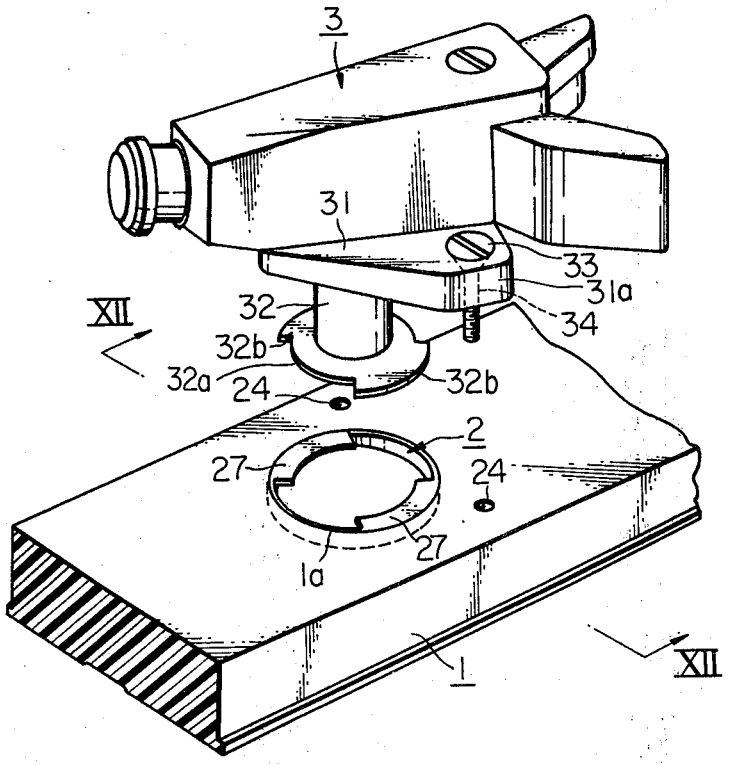
FIG. 11 is a perspective view showing another embodiment of the connecting structure according to the present invention.

In FIG. 11 which shows a further embodiment of the connecting structure for the binding clamp and the ski board, a shallow disc-shaped cavity or recess 1*a* is formed in the top surface of the ski 1 at a position where the binding clamp is to be mounted. Into this shallow cavity 1*a*, there is embedded and fixed a bracket 2 by means of adhesive bonding and so forth. The bracket 2 is open at its top and assumes a cylindrical container shape. At appropriate positions on the edge of the upper open end part, there is provided integrally and concentrically a pair of engagement pawls 27 which oppose each other.

At the same time, a ski binding clamp 3 is provided at its bottom surface with a base plate 31, beneath which there is further provided a cylindrical fitting rod 32. At the bottom surface of this fitting rod 32 there is secured a flanged portion 32*a* having a plurality of engagement pawls 32*b* in such a manner that the pawls 32*b* are concentric with the cylindrical fitting rod and the cylindrical bracket, and oppose each other. The fitting rod 32 is of a height corresponding to the depth of the bracket 31 and should not protrude above the top surface of the ski 1. The positions of the pairs of the engagement pawls 32*b* are so determined that the pairs are in a state of exact engagement when the binding clamp 3 is in its set position.

In both sides 31*a* of the base plate 31 which is integrally formed at the bottom surface of the binding clamp 3, there are formed threaded screw bolt holes 34, 34 in a direction perpendicular to the surface of the ski 1 to permit passage therein of a screw bolt 33 which is screwed into the ski 1 through a corresponding bolt hole 24 in the top surface of the ski 1. The screw bolt 33 can be tightened easily with a coin and serves to maintain the binding clamp 3 in its fixed position on the ski 1 through the bracket 2, as already explained.

Figure 12:
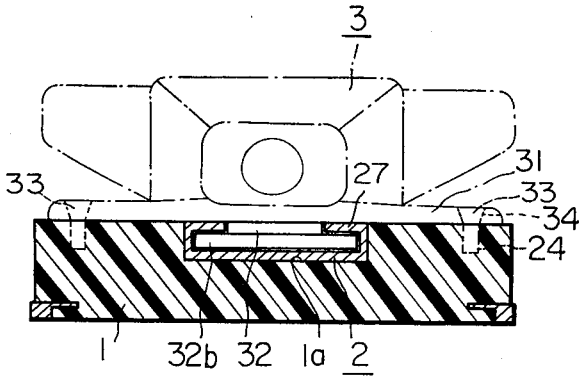
FIG. 12 is a cross-sectional view of the connecting structure as shown in FIG. 11 taken along the line XII—XII.

In using the ski, the binding clamp 3 is first assembled on the ski 1 by inserting the fitting rod 32 into the bracket 2 with the engagement pawls 32*b* thereof being positioned to be at the spaces between the opposing engagement pawls 32*b* of the bracket. Thereafter, the binding clamp 3 is turned and the pair of the engagement pawls 32*b* are caused to engaged with the engagement pawls 27 of the bracket at the required position. Finally, the position of the binding clamp 3 to the ski 1 is maintained by threading the threaded screw bolts 33 through the bolt holes 34 formed in the brim of the base plate 31 into the hole 24 in the ski 1, thereby preventing the binding clamp 3 from becoming loosened and coming out of the ski 1 unexpectedly. This state of engagement and position-setting is clearly shown in FIG. 12 from which it can be understood that the engagement pawls 32*b* of the binding clamp are so fixed that they are in position beneath the engagement pawls 27 of the bracket and cannot move at all in both the longitudinal and transverse directions.

After skiing and when shouldering the ski 1, the binding clamp 3 may be removed from the ski 1 by simply loosening and removing the screw 33, turning the binding clamp in the direction opposite that for the engagement of the pawls to release the same from engagement, and, finally, drawing the fitting rod 32 out of the cylindrical bracket 2, whereby both can be separated perfectly.

Figure 13:
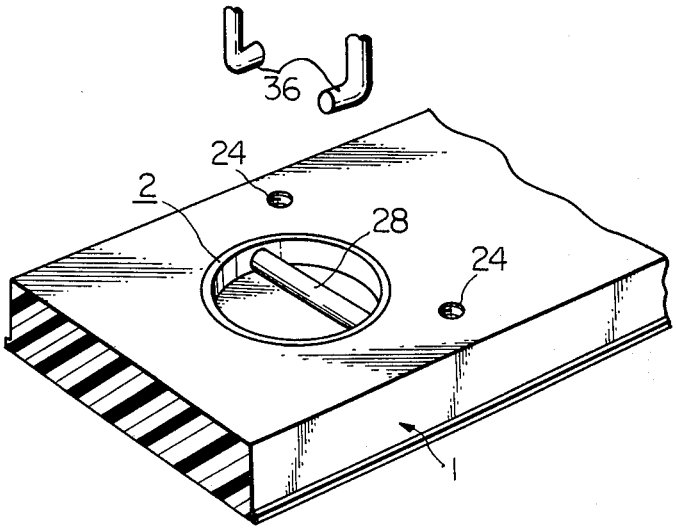
FIG. 13 is a perspective view showing a embodiment of the connecting structure for the binding clamp and ski according to the present invention.

Besides the above-described embodiment, a still further modification is contemplated as, for example, that shown in FIG. 13.

In FIG. 13, a rod 28 is spanned across the diameter of the cylindrical bracket 2 in place of the engagement pawls 32*b*, 27 of the preceding embodiment. With this rod 28, a pair of L-shaped engagement rods 36 directly extending from the bottom surface of the base plate 31 are engaged in the same manner as the engagement pawls 32*b* and 27 in the preceding embodiment.

As will now be apparent from the foregoing description, the present invention makes it easier to attach and detach a ski-binding clamp to and from a ski in such a manner that the engaging members provided at the bottom of the binding clamp engage with a counterpart in the bracket provided in the ski by simply inserting the former into the latter and causing the former to move in the internal space of the latter within the same horizontal plane as that of the ski in any required direction. The thus engaged binding clamp is maintained at its set position by at least one stopper screw bolt screwed into the ski. Removal or dismounting of the binding clamp can also be done very easily by reversing the procedures of mounting the same onto the ski, so that the carrying of the ski on the shoulder becomes easier, i.e., without suffering from the pain and annoyance at the nape, by very simple dismounting operations of the binding clamp, and the burden of additional work on the part of the dealers can therefore be remarkably reduced.

What is claimed is:

1. An apparatus for connecting a ski-binding clamp to a ski comprising:

a base plate attached to the bottom of said ski-binding clamp;

engaging means connected to said base plate and extending downward therefrom for engaging with said ski; and bracket means embedded in the upper surface of said ski removably surrounding said engaging means for locking said engaging means to said ski when said base plate is rotated horizontally relative to the surface of the ski and of said bracket means and means on the ski and the base plate to prevent rotation of the base plate to thereby maintain the clamp in a fixed position on the ski.

2. An apparatus as claimed in claim 1, wherein:

said engaging means is comprised of:

a vertical rod of circular cross-section attached beneath said base plate and extended downward therefrom, a circular plate concentrically, horizontally attached to the bottom of said vertical rod, and at least two peripherally projecting engagement pawls spaced from each other on the edge of said horizontal circular plate; and said bracket means has a circular opening in the top surface thereof of a diameter larger than the diameter of the circular plate with the engagement pawls attached thereon, and said bracket means is comprised of at least two engaging pawls spaced from each other at the edge of said circular opening extending into the center thereof and extending downward into said circular opening a distance less than the length of said vertical rod, said engaging pawls forming a central opening and pawl engagement openings spaced from each other along the perimeter of the central opening slightly larger than said horizontal circular plate with said engaging pawls attached thereto, whereby inserting said vertical rod with said horizontal circular plate with said engaging pawls attached thereto through the opening in the upper surface of said bracket means and rotating the base plate attached to said vertical rod horizontally with respect to said ski causes the engagement pawls of the horizontal circular plate to slide under the engagement pawls of the bracket means, thereby locking the base plate to the bracket means.

3. An apparatus as claimed in claim 2, wherein the thickness of said engagement pawls comprising said bracket means is sufficient to allow a snug fit with said engagement pawls attached to said horizontal circular plate at the end of said vertical rod when said rod is inserted into and rotated in said bracket means.

4. An apparatus as claimed in claim 2, wherein said bracket means is comprised of a light alloy metal such as aluminum.

5. An apparatus as claimed in claim 2, wherein the upper surface of said bracket means embedded in said ski is flush with the upper surface of said ski.

6. An apparatus as claimed in claim 1, wherein:

said engaging means is comprised of:

a first and a second vertical rod spaced from each other attached to said base plate and extending downward therefrom, a first horizontal rod attached at a right angle to the bottom of said first vertical rod, and a second horizontal rod attached at a right angle to the bottom of said second vertical rod in the direction opposing the direction of said first horizontal rod; and said bracket means is hollow, has an opening in the top surface thereof and is comprised of a span rod positioned beneath said top surface of said bracket a distance less than the length of said vertical rods and spanned across said opening, whereby inserting said vertical rods into said opening, one vertical rod on either side of said span rod, and rotating said base plate horizontally with respect to said ski surface will cause said opposing horizontal rods to slide under said span rod, thereby locking said base plate to the bracket means.

7. An apparatus as claimed in claim 6, wherein said span rod in said opening is positioned a sufficient distance beneath the surface of the bracket means to form a snug fit with the horizontal rods slid thereunder.

8. An apparatus as claimed in claim 6, wherein said bracket means is comprised of a light alloy metal such as aluminum.

9. An apparatus as claimed in claim 6, wherein the upper surface of said bracket means embedded in said ski is flush with the upper surface of said ski.

10. An apparatus as claimed in claim 1, wherein said base plate has at least one screw hole therethrough for screwing said base plate to said ski.

* * * * *